US009351580B2

(12) United States Patent
Tranback et al.

(10) Patent No.: US 9,351,580 B2
(45) Date of Patent: May 31, 2016

(54) OFFICE CHAIR WITH AN ADAPTABLE LUMBAR SUPPORT

(71) Applicant: LT Office Line AB, Nynashamn (SE)

(72) Inventors: Lennart Tranback, Saltsjobaden (SE); Goran Tollesson, Viken (SE)

(73) Assignee: LT Office Line AB, Nynashamn (SE)

( * ) Notice: Subject to any disclaimer, the term of this patent is extended or adjusted under 35 U.S.C. 154(b) by 0 days.

(21) Appl. No.: 14/376,902

(22) PCT Filed: Feb. 6, 2013

(86) PCT No.: PCT/SE2013/050097

§ 371 (c)(1),
(2) Date: Aug. 6, 2014

(87) PCT Pub. No.: WO2013/119172

PCT Pub. Date: Aug. 15, 2013

(65) Prior Publication Data

US 2015/0015041 A1 Jan. 15, 2015

(30) Foreign Application Priority Data

Feb. 6, 2012 (SE) ..... 1250084

(51) Int. Cl.
*A47C 7/46* (2006.01)
*A47C 1/032* (2006.01)
*A47C 7/48* (2006.01)

(52) U.S. Cl.
CPC ..... *A47C 7/462* (2013.01); *A47C 1/032* (2013.01); *A47C 1/03255* (2013.01); *A47C 7/46* (2013.01); *A47C 7/48* (2013.01)

(58) Field of Classification Search
CPC ..... A47C 7/462; A47C 7/48; A47C 1/032; A47C 7/46; A47C 1/03255
USPC ..... 297/300.1, 284.4, 284.8
See application file for complete search history.

(56) References Cited

U.S. PATENT DOCUMENTS 5,553,919 A 9/1996 Dennis
5,664,841 A * 9/1997 Dal Monte ..... 297/408

(Continued)

FOREIGN PATENT DOCUMENTS

EP 0458440 A 11/1991
WO 2010/087760 A1 8/2010

OTHER PUBLICATIONS

International Search Report and Written Opinion for corresponding patent application No. PCT/SE2013/050097 dated Jun. 10, 2013.

*Primary Examiner* — Milton Nelson, Jr.
(74) *Attorney, Agent, or Firm* — Renner, Otto, Boisselle & Sklar, LLP

(57) ABSTRACT

An office chair (1) including a seat (2), a backrest (3) including a lumbar support (4), an actuator device (8) arranged to enable adjustment of the lumbar support (4) between an inactive position in which it follows the general shape of the backrest (3), and a fully active position in which it is adjusted outwards forwardly from the backrest (3) in order to support the lumbar back portion of a person seated on the seat (2). The lumbar support (4) includes a first part (200) with first (201) and second (202) ends and a second part (300) with first (301) and second (302) ends. The first ends (201, 301) of the first and second parts (200, 300) are connected to each other via a pivoting point (400) and the second ends (202, 302) are pivotally coupled to the backrest (3), wherein at least one of the second ends (202, 302) of the parts (200, 300) is slidably arranged along the backrest (3) and wherein the actuator device (8) pushes and/or pulls the slidable ends (202, 302) in response to actuation.

9 Claims, 6 Drawing Sheets

(56) References Cited

U.S. PATENT DOCUMENTS

| | | | | |
|---|---|---|---|---|
| 5,806,927 | A * | 9/1998 | Schneider | 297/284.4 |
| 8,240,763 | B2 * | 8/2012 | Matano et al. | 297/284.1 |
| 2002/0130541 | A1 | 9/2002 | Koo | |
| 2003/0184139 | A1 | 10/2003 | Sloan et al. | |
| 2004/0108760 | A1 | 6/2004 | McMillen | |
| 2009/0079245 | A1 * | 3/2009 | Marcantoni | 297/284.4 |
| 2009/0146476 | A1 * | 6/2009 | Kan et al. | 297/284.4 |
| 2009/0184553 | A1 | 7/2009 | Dauphin | |

* cited by examiner

OFFICE CHAIR WITH AN ADAPTABLE LUMBAR SUPPORT

This application is a national phase of International Application No. PCT/SE2013/050097 filed Feb. 6, 2013 and published in the English language.

FIELD OF THE INVENTION

The present invention relates to an office chair with an adaptable lumbar support.

BACKGROUND OF THE INVENTION

Traditionally, office chairs have been constructed by men for men. Even though over the last decades women are just as common as men in offices, this is to a great extent still true. Most chairs are adaptable to fit persons of different length and different weight, but the main features are still adapted for men. This invention is based on extensive studies of ergonomics as well as physical and social factors, from which it has been determined that there are differences in the way women and men are sitting in office chairs.

In WO2010/087760, an office chair is described in which a lumbar support is activated for supporting the lumbar back portion of a person seated on the chair when said person is leaning forward. This chair offers support for the everyday working position for persons working in an office.

However, it has been desired to develop the office chair in WO 2010/087760 even further, since the design of the lumbar support results in that the force for adjusting the lumbar support has to be increased continuously as the lumbar support is continuously curved from an inactive position to a fully active position. For minimising the resistance given by the padding and fabric in the backrest of the chair when the lumbar support is in motion, it is important to find a material with the appropriate thickness for the padding, and an appropriate fabric for the backrest of the chair, this is costly. To be able to generate forces high enough to overcome the resistance given by the lumbar support, the padding and the fabric in the backrest, when the lumbar support is adjusted from the inactive position to the fully active position, the actuator device will have a complex structure and will hence be expensive.

Thus, there is a need for a chair with a lumbar support that gives as little resistance as possible when adjusted between the inactive position and the fully active position and that is cheaper to manufacture than previously known chairs. The invention is based on this discovery and the inventive chair has been elaborated especially for women but can be made in any size and is not limited to fit persons of a certain size or figure.

SUMMARY OF THE INVENTION

An object of the invention is to provide a chair with an adaptable lumbar support that easily can be adjusted between the inactive position and the fully active position and that can be manufactured at a low cost. The above-mentioned object is achieved by the present invention according to the claim 1.

According to a main aspect the invention relates to an office chair comprising a seat, a backrest including a lumbar support, an actuator device arranged to enable adjustment of the lumbar support between an inactive position in which it follows the general shape of the backrest, and a fully active position in which it is adjusted outwards forwardly from the backrest in order to support the lumbar back portion of a person seated. The lumbar support comprises of a first part with a first end and a second end and a second part with a first end and a second end, said first ends of said first and second parts are connected to each other via a pivoting point and said second ends are pivotally connected to the backrest, wherein at least one of said second ends of said parts is slidably arranged along the backrest wherein the actuator device is arranged to push and/or pull said slidable ends in response to actuation.

With the chair according to the invention the lumbar support will give less resistance when adjusted between an inactive position to a fully active position resulting in a more simple structure than previously known chairs with a lumbar support, and hence it can be manufactured at a lower cost than before.

Preferred embodiments of the invention are set forth in the dependent claims and in the detailed description.

SHORT DESCRIPTION OF THE APPENDED DRAWINGS

DETAILED DESCRIPTION OF THE SHOWN EMBODIMENT OF THE INVENTION

Figure 1:
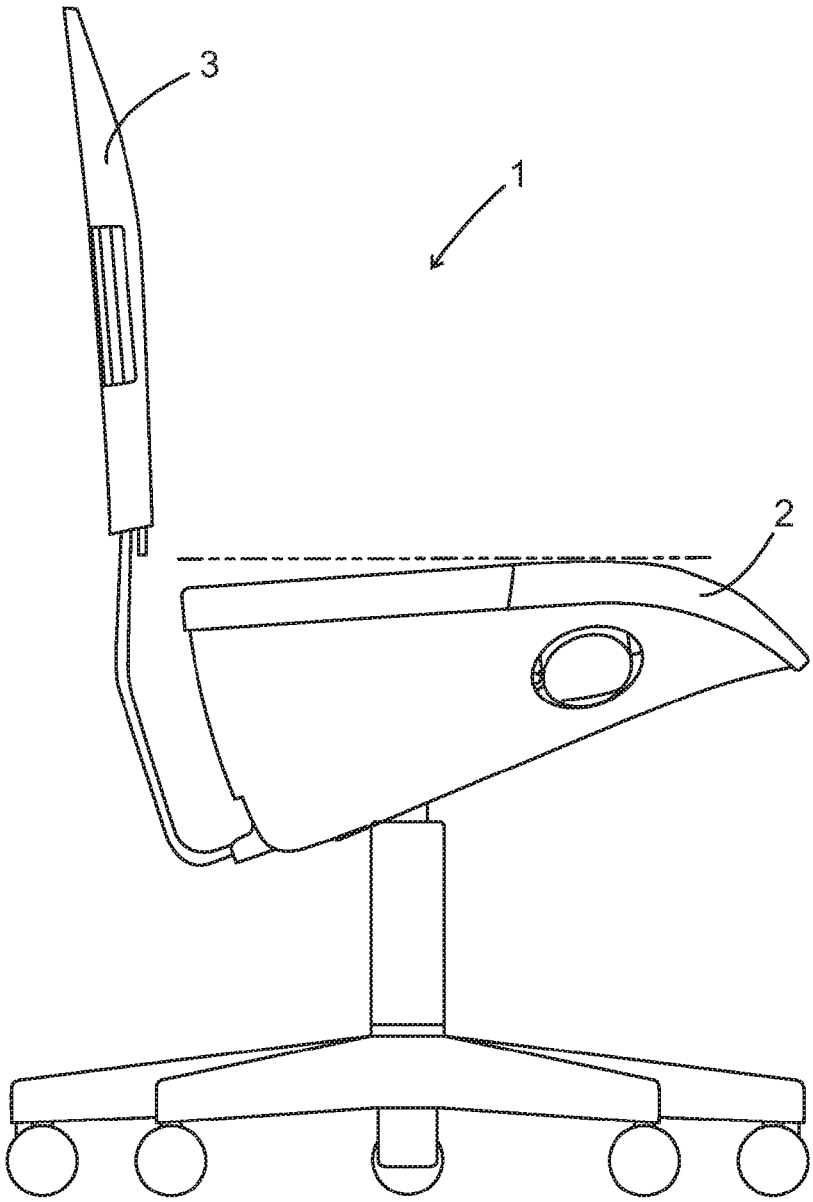
FIG. 1 shows a side view of an office chair according to one embodiment of the invention with the seat located in the normal position.
Figure 2:
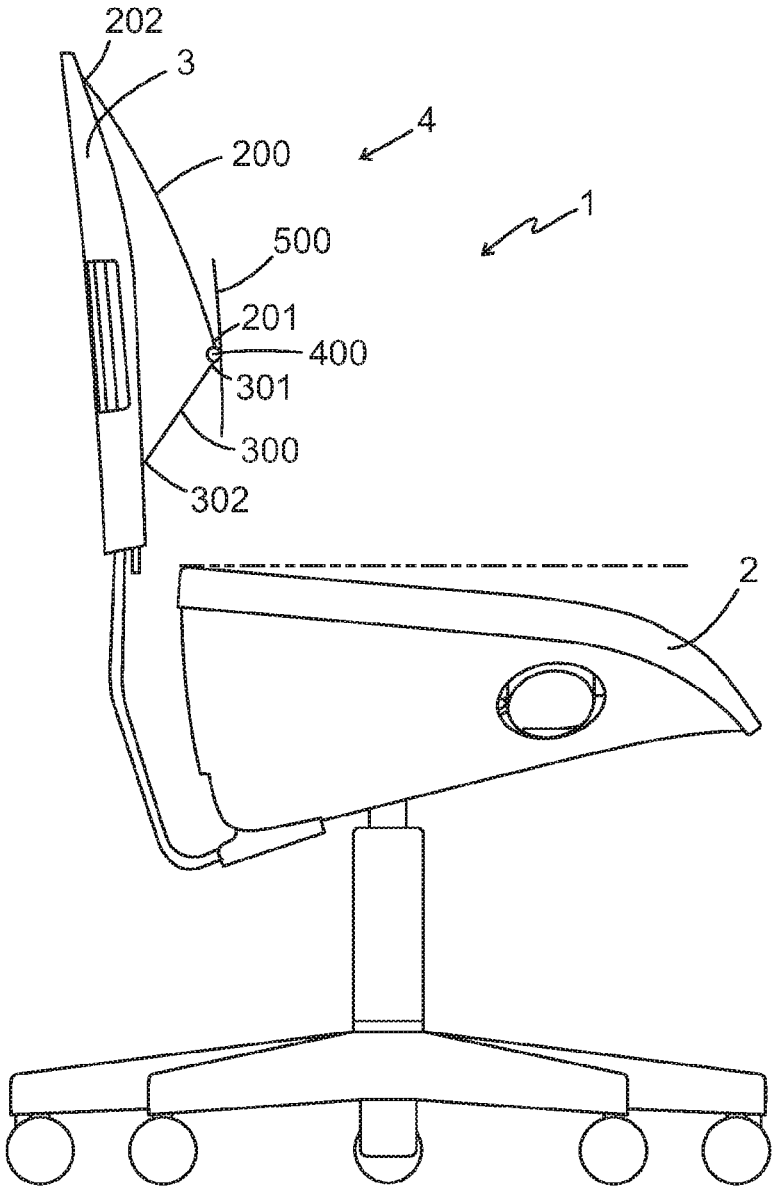
FIG. 2 shows a side view of the office chair with the seat located in a tilted position.

FIGS. 1 and 2 shows the general function of the office chair according to the shown embodiment of the invention.

The office chair 1 comprises a seat 2 and a backrest 3. The backrest 3 includes a lumbar support 4, which is adjustable between an inactive position (shown in FIG. 1) in which it follows the general shape of the backrest 3, and a fully active position (shown in FIG. 2) in which it is adjusted outwards forwardly from the backrest 3 in order to support the lumbar back portion of a person seated on the seat 2 of the chair 1. Further, the chair 1 comprises an adjustment device 8 (shown in FIG. 3-7) to enable adjustment of the lumbar support 4. In all the embodiments shown in the FIG. 1-7, the adjustment device 8 is adjusted in response to tilting of the chair 1. However, it is also possible to arrange the chair 1 so that the adjustment device 8 is adjusted in another way, e.g. in response to pulling or pushing a lever.

Figure 3:
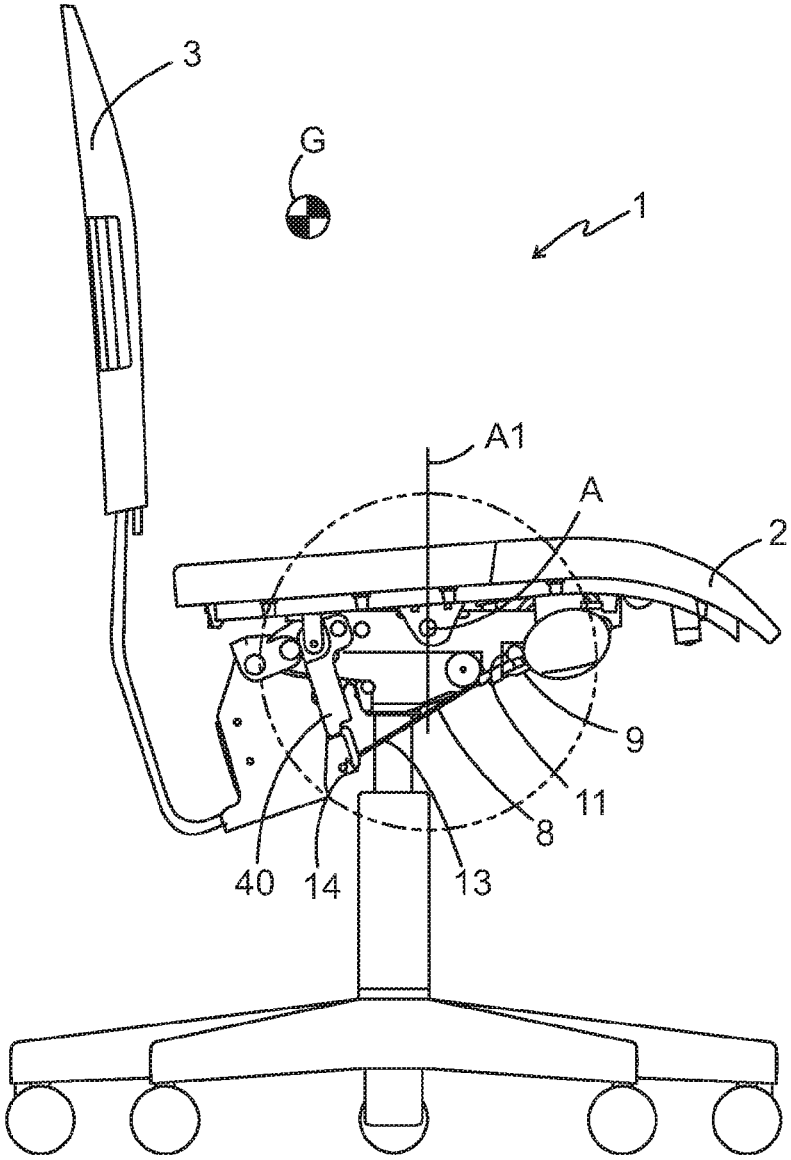
FIG. 3 shows a sectional view of the office chair from the side and with the seat located in a normal position.
Figure 4:
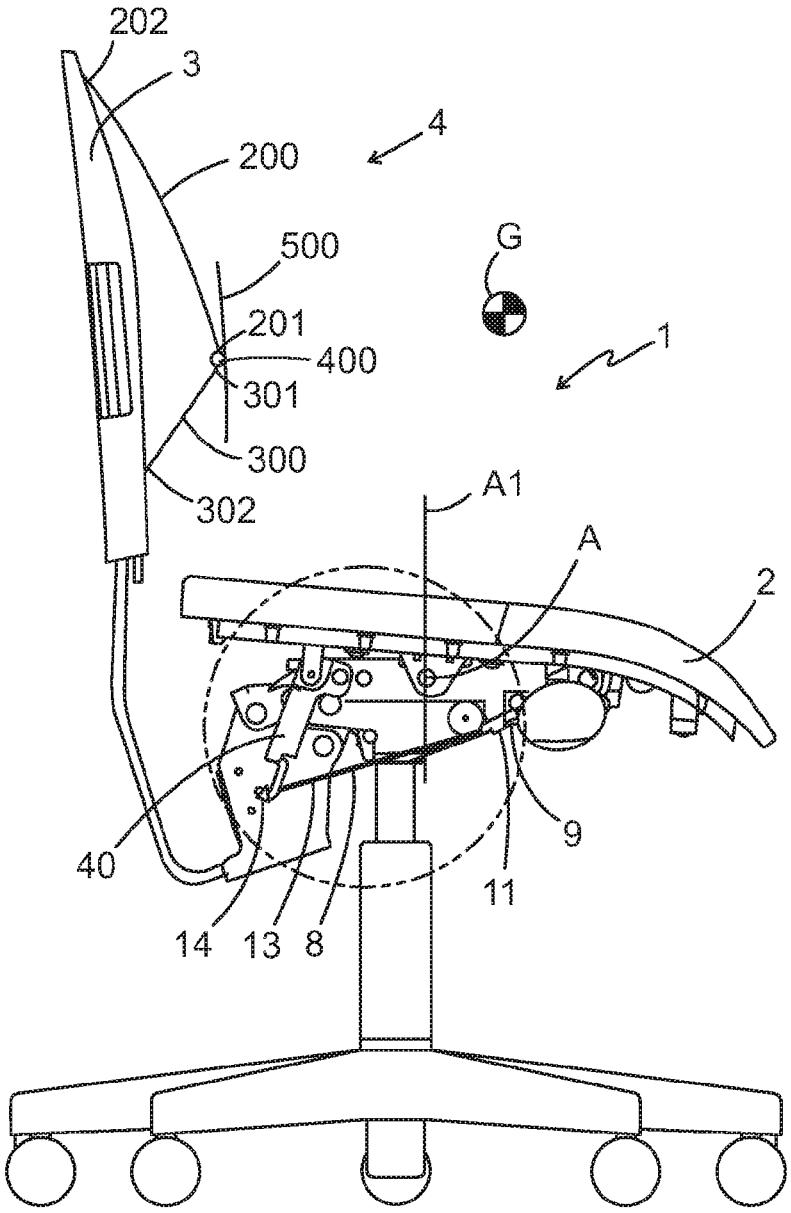
FIG. 4 shows a sectional view of the office chair from the side and with the seat located in a tilted position.

In FIGS. 3 and 4, it is shown that the seat 2 is tiltable about a pivot point A between a first position or an initial position (shown in FIG. 3), and a second slightly forwardly tilted position (shown in FIG. 4). The position of the seat 2 is adjusted by means of the centre of gravity G of a person seated in the chair, such that when the centre of gravity G is located behind the first pivot point A the seat 2 is in the initial position, and when the centre of gravity G is in front of the pivot point A the seat 2 is transferred into the tilted position. In the figures, the centre of gravity G of the person seated in the chair is represented by a chequered dot, which is to be compared with a vertical line A1 corresponding to the vertical projection of the pivot point A.

Further, as indicated above, the position of the lumbar support 4 is governed by the position of the seat 2 such that it is positioned in the inactive position (shown in FIG. 3) when the seat 2 is in the first position, and in the active position (shown in FIG. 4) when the seat 2 rests in the second position, in order to support the lumbar back portion of a person seated on the seat 2 of the chair 1 when said person is leaning forwards. This may in fact be realised in a number of ways that are obvious to a person skilled in the art once the object of the invention have been established.

A general object of the invention is to facilitate the adjustment of the lumbar support 4. According to the invention the lumbar support 4 comprises a first part 200 with a first end 201 and a second end 202 and a second part 300 with a first end 301 and a second end 302. The first end 201 of the first part 200 is connected to the first end 301 of the second part 300 via a pivoting point 400 and the second end 202 of the first part 200 and the second end 302 of the second part 300 are both pivotally coupled to the backrest 3. To enable the lumbar support 4 to be adjusted between the inactive position and the fully active position, one of or both of the second ends 202, 302 of the first and second parts 200, 300, respectively, is slidably coupled to the backrest 3. To enable a comfortable support of the lumbar back portion of a person seated on the chair even in the activated position, the lumbar support also comprises a back plate 500.

The function of the lumbar support 4, will now be described with reference to FIGS. 5, 6 and 7.

Figure 5:
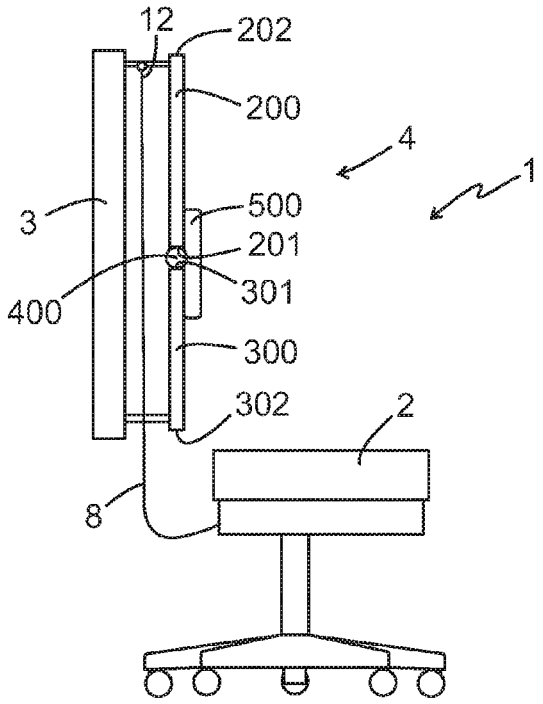
FIG. 5 shows a first embodiment in a side view of the office chair with the backrest in a sectional view.

In the office chair 1 in the shown embodiment of FIG. 5, a wire 8 is arranged between the seat 2 and the lumbar support 4, a first end 12 of the wire is connected to second end 202 of the first part 200 of the lumbar support 4 and a second end 13 (se FIGS. 3 and 4) of the wire 8 is connected to the seat 2 of the chair 1. In FIG. 5, the second end 202 of the first part 200 of the lumbar support 4 is slidably coupled to the backrest 3 and the second end 302 of the second part 300 and the lumbar support 4 is connected to the backrest 3. When the seat is tilted from the initial position, the seat 2 pulls the first end 12 of the wire 8, which results in that the second end 13 of the wire 8 is pulling the slidable second end 202 of to the first part 200 of the lumbar support 4 downwards, to position the lumbar support 4 in the active position.

Figure 6:
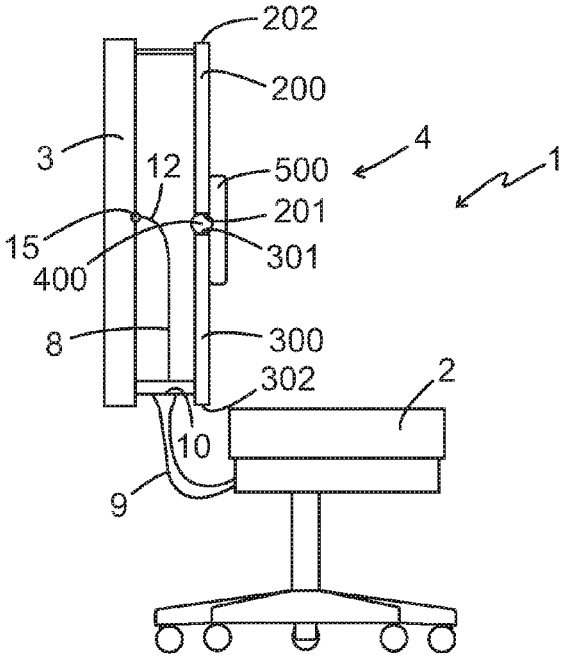
FIG. 6 shows a second embodiment in a side view of the office chair with the backrest in a sectional view.

In the office chair 1 in the shown embodiment of FIG. 6, a wire 8 is arranged between the seat 2 and the lumbar support 4, a first end 12 of the wire 8 is connected to the backrest 3 and the second end 13 of the wire 8 is connected to is the seat 2 of the chair 1 (se FIGS. 3 and 4). In FIG. 6 the second end 302 of the second part 300 of the lumbar support 4 is slidably coupled to the backrest 3 and the second end 202 of the first part 200 of the lumbar support 4 is connected to the backrest 3. The wire 8 is arranged inside a rigid sheath 9 such that it is free to move co-axially inside the sheath 9, wherein the sheath 9 having two openings 10, 11, through which the ends 12, 13 of the wire 8 extends. In this embodiment the wire 8 runs in a loop under the seat and said second end 13 of the wire 8 exits the second opening 11 of the sheath 9 and is attached to a fixing point 14 on a lever 40 (se FIGS. 3 and 4) on the underside of the seat 2 and the first end 12 of the wire 8 exits the first opening 10 of the sheath 9 and is connected to a fixing point 15 at the backrest 3 of the chair 1. The function of the sheathed wire 8 is similar to the function of a shoe brake, used e.g. on bikes.

When the seat 2 is tilted from the initial position, the lever 40 is arranged to be activated when the seat 2 is tilted, wherein the lever 40 pulls the second end 13 of the wire 8 so that the wire 8 successively will exit the second opening 11 of the sheath 9. In order for this to work, the sheath openings 10, 11 need to restrict the sheath 9 from moving with the wire 8. The easiest way to arrange this is of course to couple the openings 10, 11 opposed to and in the vicinity of the respective fixture point 14, 15 of the wire ends 12, 13. Since the sheath 9 is ridged and is restricted from moving with the wire 8, and the loop of the wire 8 on the underside of the seat 2 is shortened when the lever 40 pulls the second end 13 of the wire 8, the first opening 10 of the sheath 9 will move towards the first end 12 of the wire 8 and hence push the second end 302 of the slidable second part 300 of the lumber support 4 upwards, to position the lumber support 4 in the active position.

Figure 7:
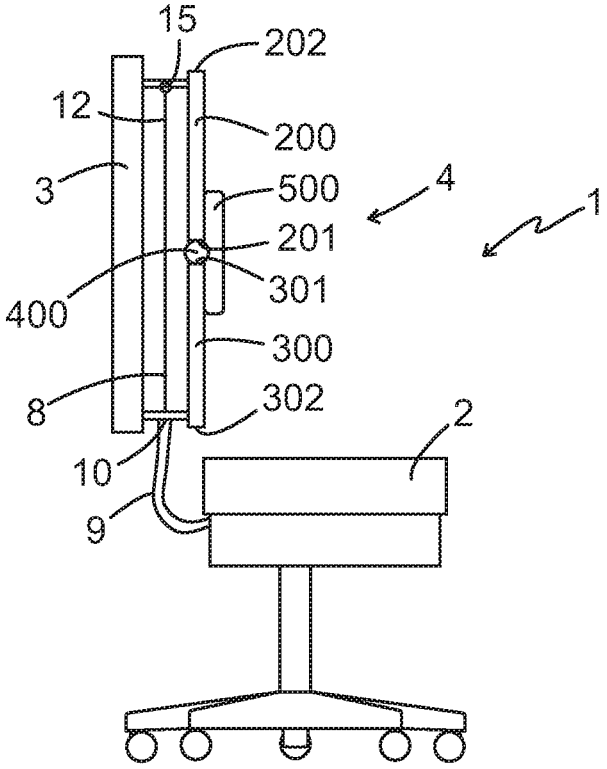
FIG. 7 shows a third embodiment side view of the office chair with the backrest in a sectional view.

The embodiment of the office chair 1 in FIG. 7 is similar to the embodiment in FIG. 6, but with the difference that both the second end 202 of the first part 200 of the lumber support 4 and the second end 302 of the second part 300 of the lumber support 4 are slidably arranged in the backrest 3 and that the first end 12 of the wire 8 is coupled to said second end 202 of the first part 200 of the lumber support 4.

The present invention is not limited to the above described preferred embodiments. Various alternatives, modifications and equivalents may be used. Therefore, the above embodiments should not be taken as limiting the scope of the invention, which is defined by the appending claims.

The invention claimed is:

1. An office chair comprising a seat, a backrest including a lumbar support, an actuator device arranged to enable adjustment of the lumbar support between an inactive position in which it follows the general shape of the backrest, and an active position in which it is adjusted outwards forwardly from the backrest in order to support a lumbar back portion of a person when seated on the seat, wherein the lumbar support includes a first part with a first end and a second end and a second part with a first end and a second end, said first ends of said first and second parts are connected to each other via a pivoting point and said second ends are pivotally coupled to the backrest, wherein at least one of said second ends of said parts is slidably arranged along the backrest, wherein the actuator device pushes or pulls said one of said second ends in response to actuation, so as to cause a sliding movement of said one of said second ends, wherein the seat is tiltable between an initial position and a relatively forwardly tilted position, and wherein the actuator device causes said pushing or pulling on said one of said second ends in response to tilting of the seat.

2. The office chair according to claim 1, wherein the seat is supported for pivotal movement about a horizontal axis such that the position of the seat is adjustable by the weight of a person when seated on the seat between the initial position when the centre of gravity of the person when seated in the chair is located rearwardly of the horizontal axis and the relatively forwardly tilted position when the centre of gravity of the person when seated in the chair is located forwardly of the horizontal axis, and wherein the position of the lumbar support is governed by the position of the seat such that it is positioned in the inactive position when the seat is in the initial position, and in the active position when the seat is in the relatively forwardly tilted position, in order to support the lumbar back portion of a person when seated on the seat of the chair and when said person is leaning forwards.

3. The office chair according to claim 1, wherein said actuator device is a wire having a second end connected to the underside of the seat and a first end connected to the second end of the first part of the lumbar support, said second end of the first part being slidably coupled in the backrest and said second end of the second part being connected in the backrest in order to enable adjustment of the lumbar support between the inactive position and the active position and wherein the first end of the wire is pulled downwards as the seat is tilted into the tilted position, which results in the first end of the wire acting on the lumbar support, to position the lumbar support in the active position.

4. The office chair according to claim 1, wherein both the second end of the first part and the second end of the second part of said lumbar support are slidably arranged in the backrest, said actuator device is a wire arranged inside a rigid sheath such that the wire is free to move co-axially inside the sheath, said sheath has two openings, a second opening from which a second end of the wire exits and connects to a lever on the underside of the chair, and a first opening from which a first end of the wire exits and connects to the second end of the first part of the lumber support, wherein the wire and the sheath runs in a loop underside the seat, and when the lever pulls the wire as the seat is tilted into the relatively forwardly tilted position the second opening of the sheath is pushed away from the second end of the wire, which results in the first opening of the sheath acting on the second end of the second part of the lumber support and the first end the wire acting on the second end of the first part of the lumbar support, to position the lumbar support in the active position.

5. The office chair according to claim 1, wherein the second end of the second part of said lumbar support is slidably arranged in the backrest and in that said actuator device is a wire arranged inside a rigid sheath such that the wire is free to move coaxially inside the sheath, said sheath having two openings, a second opening from which a second end of the wire exits and connects to a lever on the underside of the chair, and a first opening from which a first end of the wire exits and connects to a fixing point on the backrest, the wire and the sheath runs in a loop underside the seat and wherein the lever pulls the wire as the seat is tilted into the relatively forwardly tilted position the second opening of the sheath is pushed away from the second end of the wire, which results in that the first opening of the sheath acts on the second end of the second part of the lumber support, to position the lumbar support in the active position.

6. The office chair according to claim 1, wherein the lumbar support is provided with a back plate to support the back of a person when sitting in the chair in the active position.

7. The office chair of claim 1, wherein the tilting of the seat is limited, such that it is arranged to tilt maximally about 10°.

8. The office chair of claim 1, wherein the seat of the chair is pre-stressed into the initial position.

9. The office chair of claim 1, wherein the tilting of the seat is limited, such that it is arranged to tilt maximally about 5°.

* * * * *